US007414504B2

(12) United States Patent
Lundstrom et al.

(10) Patent No.: US 7,414,504 B2
(45) Date of Patent: Aug. 19, 2008

(54) LAMINATED SOLENOID PLUNGER FOR SOLENOID ASSEMBLY

(75) Inventors: Robert W. Lundstrom, Plymouth, MN (US); Peter E. Johnson, Maple Grove, MN (US)

(73) Assignee: DataCard Corporation, Minnetonka, MN (US)

( * ) Notice: Subject to any disclaimer, the term of this patent is extended or adjusted under 35 U.S.C. 154(b) by 120 days.

(21) Appl. No.: 11/452,534

(22) Filed: Jun. 14, 2006

(65) Prior Publication Data

US 2007/0290779 A1 Dec. 20, 2007

(51) Int. Cl.
*H01F 3/00* (2006.01)
*H01F 7/08* (2006.01)

(52) U.S. Cl. ..... 335/255; 335/214; 335/220; 335/224; 335/251; 335/257; 335/259; 335/263; 335/264; 335/298

(58) Field of Classification Search ..... 335/214, 335/220, 224, 251, 255, 257, 259, 263, 264, 335/298

See application file for complete search history.

(56) References Cited

U.S. PATENT DOCUMENTS 2,311,890 A * 2/1943 Trombetta ..... 335/257
2,467,489 A * 4/1949 McClain ..... 335/245
2,468,052 A * 4/1949 Fisher
2,544,491 A * 3/1951 Davis ..... 335/257
2,582,351 A * 1/1952 Olson ..... 335/262
2,594,089 A * 4/1952 Soreng et al. ..... 335/249
2,665,397 A * 1/1954 Jencks ..... 335/257
2,715,199 A * 8/1955 Bogue et al. ..... 335/245
2,817,729 A * 12/1957 Lawrence ..... 335/103
2,877,390 A * 3/1959 Trombetta ..... 335/245
2,899,609 A * 8/1959 Andrews ..... 335/255
3,152,289 A * 10/1964 Trombetta ..... 335/251
3,501,724 A * 3/1970 Westphal ..... 335/248
3,577,107 A * 5/1971 Widl et al. ..... 335/248
3,605,054 A * 9/1971 Conrath ..... 335/243
3,621,421 A * 11/1971 Conrath ..... 335/257

(Continued)

FOREIGN PATENT DOCUMENTS

JP 57-180107 11/1982

OTHER PUBLICATIONS

PCT/ISA/237 for corresponding International Application No. PCT/US2007/071115.

(Continued)

*Primary Examiner*—Elvin Enad
*Assistant Examiner*—Mohamad A Musleh
(74) *Attorney, Agent, or Firm*—Hamre, Schumann, Mueller & Larson, P.C.

(57) ABSTRACT

A solenoid plunger for use in solenoid driven multi-line embossing systems is constructed of magnetic steel laminations that are attached to a center block which is machined to mount a solenoid shaft and anti-rotate pins. The laminations are attached to the center block with screws and vacuum epoxy glued for a very high cycle life. The laminated steel construction dramatically reduces eddy currents, which allows the magnetic field to rise and fall much more quickly than a conventional steel plunger. It also increases the magnetic force in the solenoid. This reduction in solenoid plunger eddy currents and increase of magnetic force in the solenoid structure itself operates to increase embosser throughput. The laminated steel construction further reduces embosser solenoid heating which also contributes to improved embossing control.

18 Claims, 5 Drawing Sheets

U.S. PATENT DOCUMENTS

| | | | | |
|---|---|---|---|---|
| 3,633,139 | A * | 1/1972 | Thompson | 335/255 |
| 3,992,688 | A * | 11/1976 | Keck | 335/272 |
| 4,227,142 | A * | 10/1980 | Jarret et al. | 322/3 |
| 4,335,338 | A * | 6/1982 | Sawyer | 318/135 |
| 4,674,897 | A * | 6/1987 | West et al. | 400/124.18 |
| 4,749,891 | A * | 6/1988 | Sheng | 310/15 |
| 4,862,127 | A * | 8/1989 | Lundstrom et al. | 335/257 |
| 5,453,821 | A | 9/1995 | Howes, Jr. et al. | |
| 5,515,818 | A * | 5/1996 | Born | 123/90.11 |
| 6,420,949 | B1 * | 7/2002 | Umemoto et al. | 335/251 |
| 6,550,745 | B2 * | 4/2003 | Bergstrom et al. | 251/129.16 |
| 6,922,124 | B2 | 7/2005 | Segi et al. | |
| 7,218,197 | B2 * | 5/2007 | Sutardja | 336/175 |
| 2005/0001702 | A1 * | 1/2005 | Norton et al. | 335/220 |
| 2005/0088265 | A1 * | 4/2005 | Nakagawa et al. | 335/220 |
| 2005/0253675 | A1 * | 11/2005 | Davison | 335/220 |
| 2006/0061442 | A1 * | 3/2006 | Brooks | 335/220 |

OTHER PUBLICATIONS

PCT/ISA/210 for corresponding International Application No. PCT/US2007/071115.

* cited by examiner

Prior Art

LAMINATED SOLENOID PLUNGER FOR SOLENOID ASSEMBLY

BACKGROUND OF THE INVENTION

1. Field of the Invention

The present invention is directed to an embossing machine solenoid plunger, and more particularly to a laminated solenoid plunger plate that operates to improve embosser card throughput and emboss height control associated with embossers used to emboss credit cards, among other things.

2. Description of the Prior Art

Known solenoid driven embossing systems generally encounter the challenges associated with providing a solenoid body assembly that limits heating of the solenoid structure due to eddy-current losses in the material used to construct the solenoid body assembly and that enhances the durability and precision of the solenoid embossing structure. The prior art shows the use of magnetic materials such as laminated steel for the solenoid body assembly. Known solenoid structures however, such as that disclosed in U.S. Pat. No. 5,453,821, entitled Apparatus for Driving And Controlling Solenoid Impact Imprinter, issued Sep. 26, 1995, to Howes, jr., et al. continue to employ solenoid structure plunger mechanisms that place undesirable constraints on multi-line embosser throughput and embossing accuracy.

In view of the foregoing, it would be advantageous and beneficial to provide a solenoid plunger structure for use in solenoid driven multi-line embossing systems that operates in association with a solenoid body assembly to further enhance the throughput of a solenoid driven card embossing system without any reduction in durability and precision of the card embossing system.

SUMMARY OF THE INVENTION

The present invention is directed to a laminated solenoid plunger structure particularly suitable for use in solenoid driven card embossing systems that operate in association with a solenoid body assembly to further enhance the throughput of a solenoid driven card embossing system without resulting in any reduction in system durability and precision. The solenoid plunger, in one embodiment, is constructed of magnetic steel laminations that are attached to a center block which is machined to mount a solenoid shaft and anti-rotate pins. The laminations are attached to the center block with screws and vacuum epoxy glued for a very high cycle life. The laminated steel construction dramatically reduces eddy currents, which allows the magnetic field to rise and fall much more quickly than a conventional steel plunger. It also increases the magnetic force in the solenoid. This reduction in solenoid plunger eddy currents and increase of magnetic force in the solenoid structure itself operates to increase embosser throughput (10 msec per character for example, in one embodiment, which correlates to a 7% improvement for a 40 character card). The laminated steel construction further reduces embosser solenoid heating which also contributes to improved embossing control.

Further, the laminated steel most preferably is "cold rolled grain oriented" (CRGO) steel. The orientation of the grain has been found to provide important magnetic advantages. The laminated steel also most preferably has a very thin electrically insulating coating on each lamination surface to prevent eddy currents, discussed herein above, from flowing from one lamination to another.

According to one embodiment, a solenoid plunger plate comprises first and second laminated stacks, each stack having a plurality of alignment cavities, each alignment cavity configured for receiving an alignment mechanism there through, wherein laminations within each stack are abutting adjacent laminations; a center block having a plurality of alignment cavities, each alignment cavity configured to receive an alignment mechanism, the center block disposed between the first and second laminated stacks; a clamp having a plurality of alignment cavities and configured to receive the first and second laminated stacks and the center block therein; and a plurality of alignment mechanisms, each alignment mechanism being inserted into a respective clamp alignment cavity, a corresponding first stack alignment cavity, a corresponding second stack alignment cavity and a corresponding center block alignment cavity and configured to tighten the clamp against the first and second laminated stacks and the center block, wherein the first and second laminated stacks, center block and clamp together are aligned to provide a substantially flat face portion of the solenoid plunger plate.

According to another embodiment, a solenoid plunger plate comprises first and second laminated stacks, each stack having a plurality of alignment cavities, each alignment cavity configured for receiving an alignment mechanism there through, wherein laminations within each stack are abutting adjacent laminations; a center block having a plurality of alignment cavities, each alignment cavity configured to receive an alignment mechanism, the center block disposed between the first and second laminated stacks; and a plurality of alignment mechanisms, each alignment mechanism being inserted into a respective first stack alignment cavity, a corresponding second stack alignment cavity and a corresponding center block alignment cavity and configured to secure the first and second laminated stacks against the center block, wherein the first and second laminated stacks and the center block together are aligned to provide a substantially flat face portion of the solenoid plunger plate.

According to yet another embodiment, a method of operating a solenoid plunger plate comprises the first step of providing a solenoid plunger plate comprising first and second laminated stacks, each stack having a plurality of alignment cavities, each alignment cavity configured for receiving an alignment mechanism there through, wherein laminations within each stack are abutting adjacent laminations; a center block having a plurality of alignment cavities, each alignment cavity configured to receive an alignment mechanism, the center block disposed between the first and second laminated stacks; and a plurality of alignment mechanisms, each alignment mechanism being inserted into a respective first stack alignment cavity, a corresponding second stack alignment cavity and a corresponding center block alignment cavity and configured to secure the first and second laminated stacks against the center block, wherein the first and second laminated stacks and the center block together are aligned to provide a substantially flat face portion of the solenoid plunger plate; the second step of slidably attaching the solenoid plunger plate to a solenoid body assembly such that the substantially flat face portion of the solenoid plunger faces the solenoid body assembly to formulate a solenoid structure; and the third step of activating the solenoid structure to selectively cycle the solenoid plunger plate toward and away from the solenoid body assembly.

BRIEF DESCRIPTION OF THE DRAWINGS

Other aspects and features of the present invention and many of the attendant advantages of the present invention will be readily appreciated as the same becomes better understood by reference to the following detailed description when considered in connection with the accompanying drawings in which like reference numerals designate like parts throughout the figures thereof and wherein.

While the above-identified drawing figure sets forth a particular embodiment, other embodiments of the present invention are also contemplated, as noted in the discussion. In all cases, this disclosure presents illustrated embodiments of the present invention by way of representation and not limitation. Numerous other modifications and embodiments can be devised by those skilled in the art which fall within the scope and spirit of the principles of this invention.

DETAILED DESCRIPTION OF THE PREFERRED EMBODIMENTS

Figure 1:
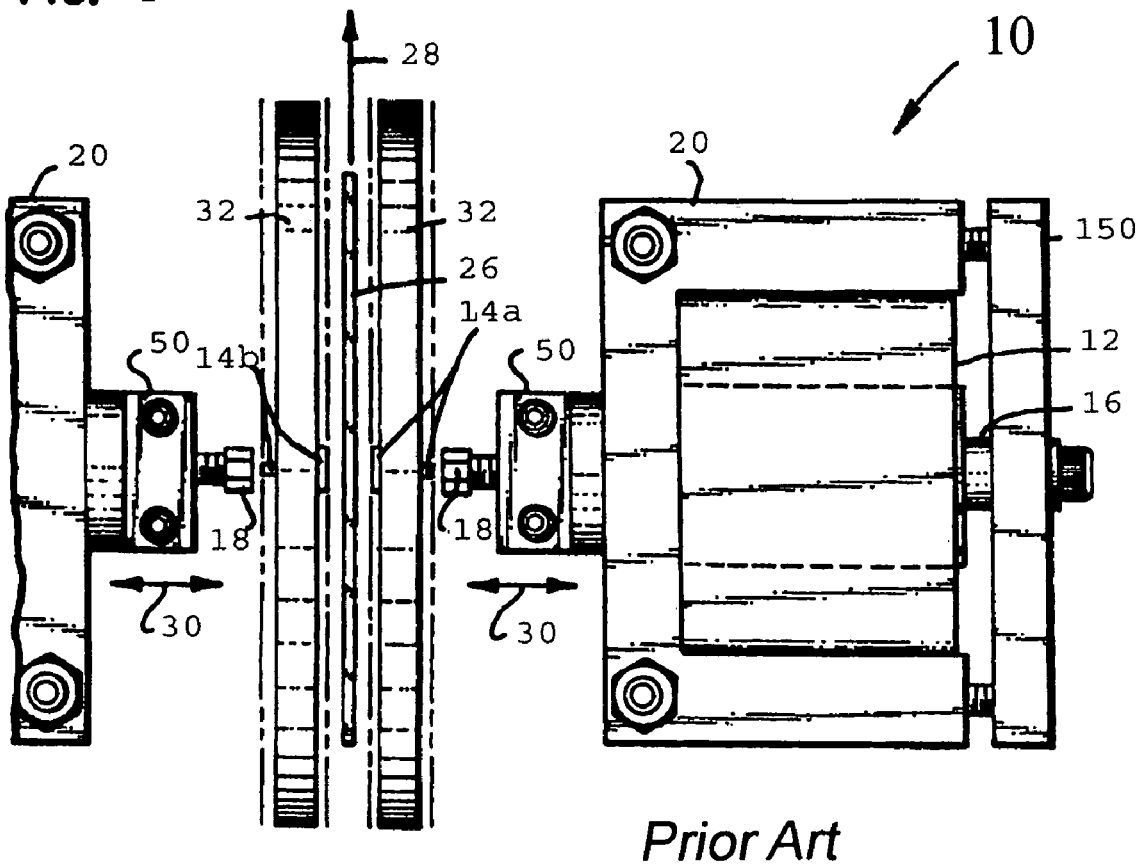
FIG. 1 is a top plan view showing the main elements of a solenoid structure used to drive an embosser according to one embodiment.
Figure 2:
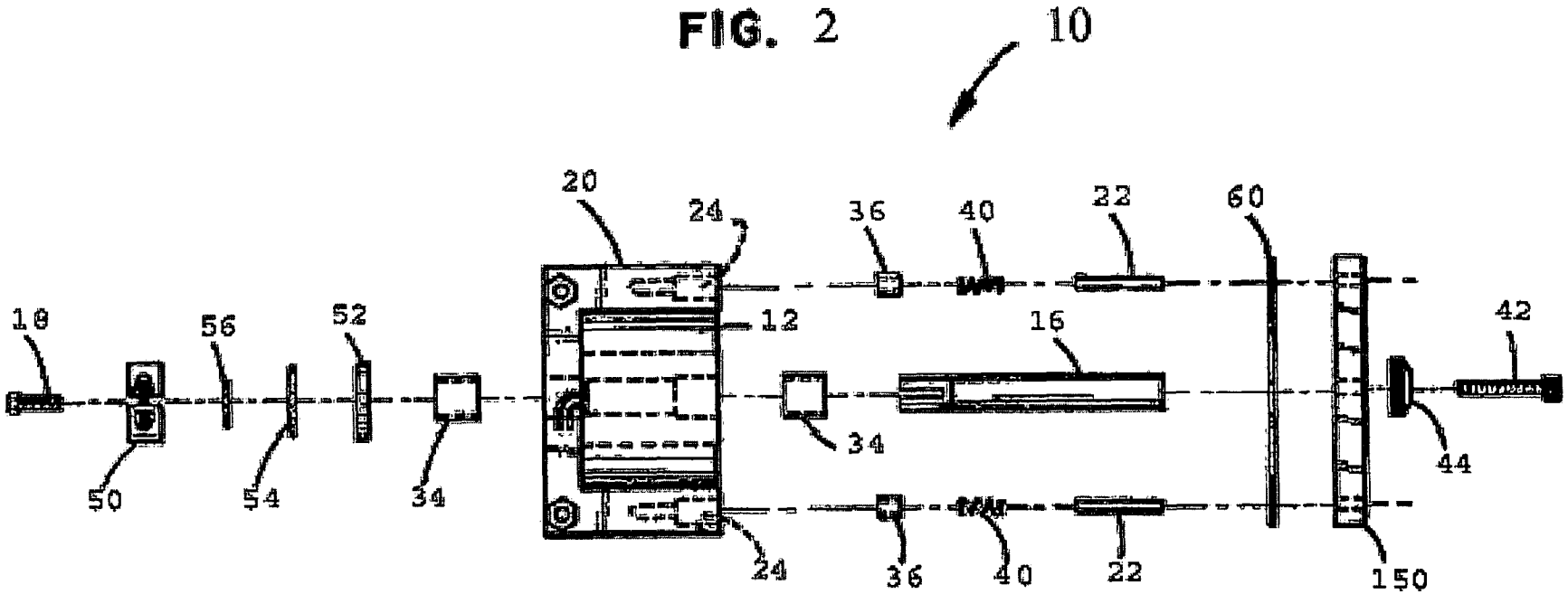
FIG. 2 Prior Art
FIG. 2 is an exploded assembly of the solenoid structure shown in FIG. 1.
Figure 3:
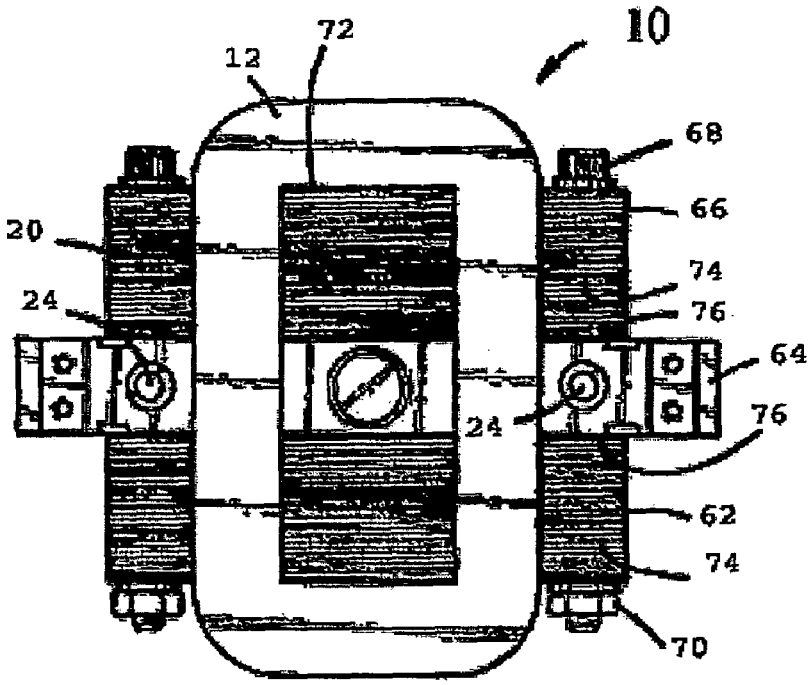
FIG. 3 Prior Art
FIG. 3 is a front plan view showing the main nonmoving elements of an embodiment of the solenoid structure shown in FIG. 1.

FIGS. 1, 2 and 3 show one embodiment of a prior art solenoid structure 10 that may be used as part of an embossing machine. The solenoid structure 10 includes a solenoid coil 12, embossing elements 14*a* and 14*b*, a shaft 16 attached to an anvil 18 and suspended within the solenoid coil 12, and a plunger 150 slidably connected to the solenoid body assembly 20 through alignment pins 22 and cavities 24 for receiving the alignment pins 22.

Generally, when current is passed through the solenoid coil 12, a net magnetic field results along the axis of the shaft 16. The magnetic field, in turn, attracts the plunger 150, thereby moving the shaft 16 causing the embossing element 14*a* to emboss the chosen material. Thus, by controlling the current in the solenoid coil 12, the embossing elements 14*a*, 14*b*, can be controlled.

Looking again at FIG. 1, the solenoid structure 10 is positioned with respect to the material 26 to be embossed, i.e., a credit card, and the card path 28. Although not shown, a second solenoid structure could be used to drive print element 14*b* in the same manner as embossing element 14*a* is driven. As a current pulse is applied through the solenoid coil 12, the shaft/plunger/anvil arrangement 16, 150, 18 are actuated in the direction shown by arrows 30. The anvil 18 engages embossing element 14*a*, which is held within a retaining band 32, and the embossing element engages and embosses the credit card 26 in response to the current pulses. In a two-solenoid embossing system, embossing element 14*b* is also actuated by the current pulses. In a single solenoid embossing system, embossing element 14*b* is in a stationary position adjacent the material to be embossed.

Moving now to FIG. 2, the cavity and alignment pin arrangement 24, 22 prevents the plunger 150 from rotating while the bushings 34 slidably align the shaft 16 within the solenoid 10 body 20. Alignment pins 22 are attached to the plunger 150 and are slidably received in bearings 36 located in cavities 24. Return springs 40 are coaxially disposed about the alignment pins 22 and received in the cavities 24 for returning the plunger 150 to and holding the plunger 150 in the at rest position. Bearings 36 permit the alignment pins 22 to easily move with respect to the solenoid body assembly 20. The socket screw 42 and washers 44 attach the plunger 150 to the shaft 16. The anvil 18 is threadably attached to the shaft 16 and secured by a collar member 50. A damping washer 52, a thrust washer 54, and a retaining ring 56 cooperate to provide an at-rest stop function for the shaft/plunger/anvil arrangement 16, 150, 18. Shim 60 is attached to the plunger 150 to provide a nonmagnetic gap so as to prevent the plunger 150 from sticking to the solenoid body assembly 20 when there is no current flowing in the coil 12.

Figure 4:
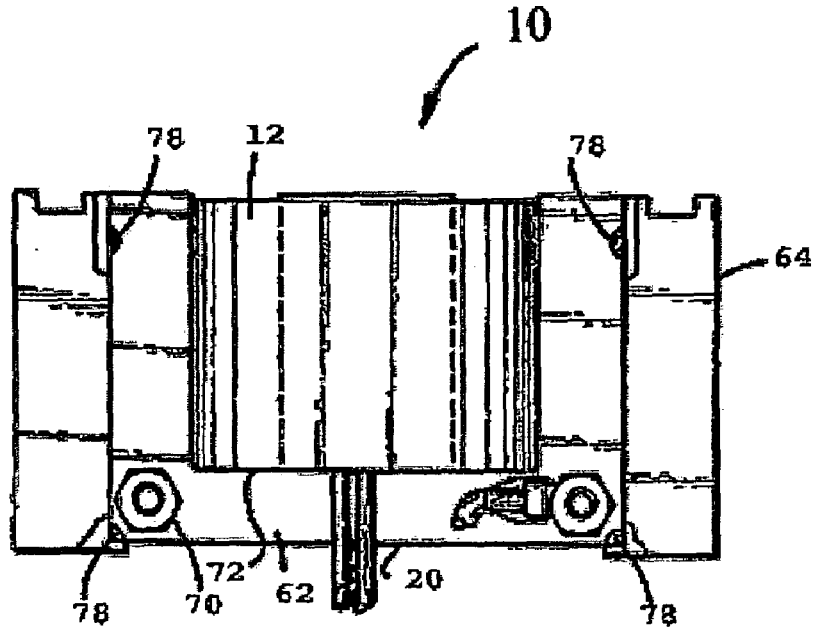
FIG. 4 Prior Art
FIG. 4 is a bottom plan view of the solenoid structure shown in FIG. 3.

FIGS. 3 and 4 best show the solenoid body assembly 20. Structurally, the solenoid body assembly 20 includes the following parts: a first stack 62 of steel laminations; a center block 64, a second stack 66 of steel laminations, a cap screw and nut assembly 68, 70, a first adhesive 72, a second adhesive 74 and a third adhesive 76. The solenoid body assembly 20 is attached to the solenoid coil 12 using the first adhesive 72. In the preferred embodiment, the first adhesive 72 is epoxy but may also be, for example, RTV silicone. The laminations are preferably steel but may also be made of a suitable magnetic material having a large electrical resistance such as a sintered material which minimizes eddy-currents and power loss caused by eddy-currents. In the preferred embodiment, the center block 64 is made of aluminum or some other nonmagnetic material. In alternative embodiments, the center block 64 might be made of magnetic materials such as steel. In yet other embodiments, the center block 64 might not be present. Rather, the solenoid body 20 could include a single stack of laminations machined to receive the shaft plunger/anvil/arrangement 16, 150, 18. To form the first and second stacks 62, 66, the second adhesive 74 is applied over the entire surface of each lamination to hold the laminations together. In the preferred embodiment, the laminations are bonded together with epoxy; for example, by vacuum impregnating with epoxy. One specific example is #8821 with C321 reactor sold by Epoxylite of California. Another adhesive product which might be used in alternative embodiments of the invention is a cyanoacrylate such as Superbonder #420 made by Loctite of Connecticut. Before assembling the first stack 62, the center block 64 and the second stack 66, the laminations within each stack may be welded together in at least one place (FIG. 4 illustrates four weld spots 78.) The weld spots 78 facilitate alignment and provide for electrical continuity between all laminations. The center block 64 is then attached to the first stack 62 and the second stack 66 using the third adhesive 76 over the entire contact surface between the center block 64 and laminations. In the preferred embodiment, the adhesive 76 is epoxy. In an alternative embodiment, the third adhesive 76 is an anaerobic adhesive such as Speedbonder #324 made by Loctite of Connecticut. Finally, to further secure the center block 64 between the first and second stacks 62, 66, a cap screw 68 and nut 70 assembly is used as shown in FIG. 3.

Figure 5:
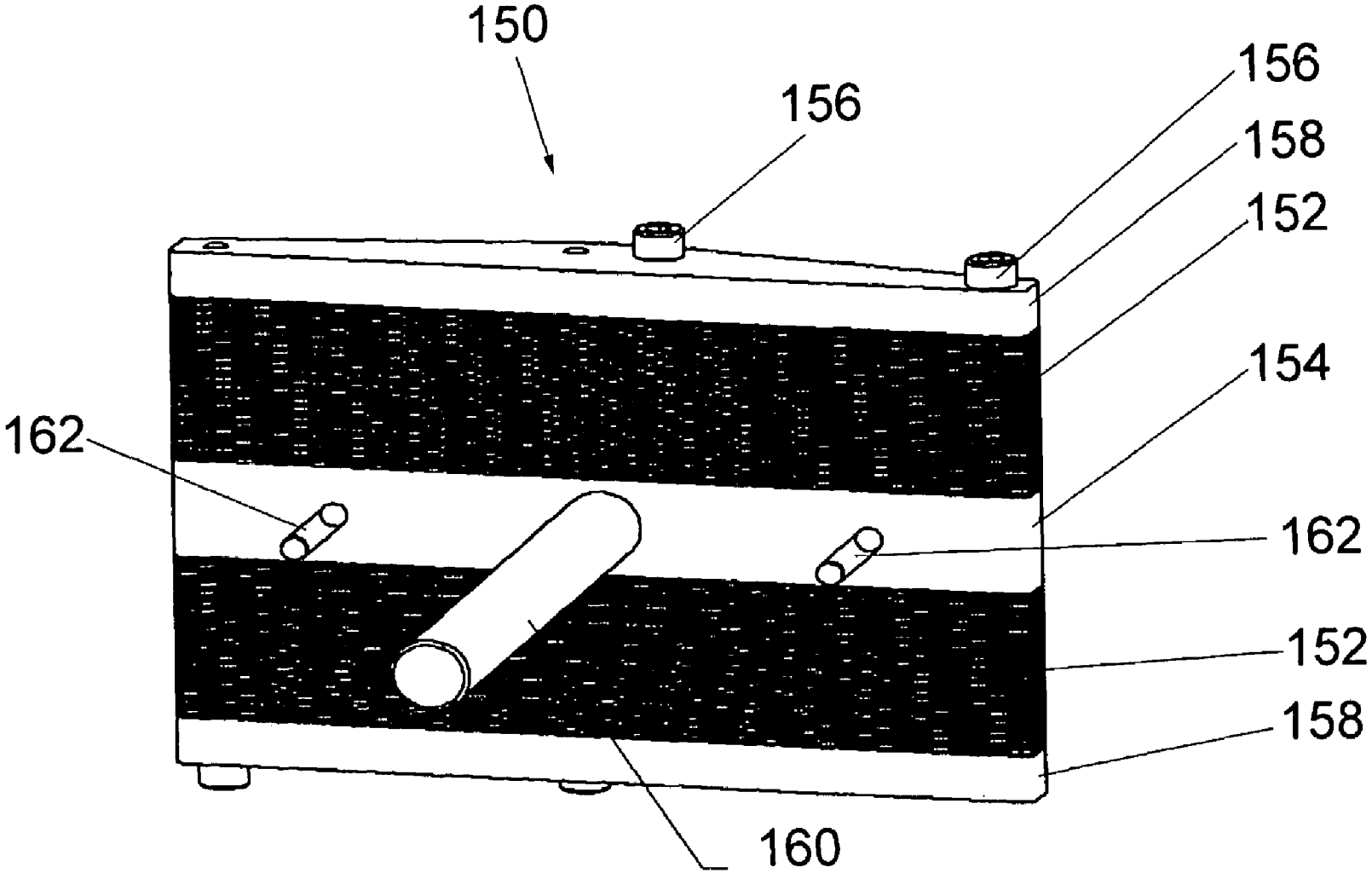
FIG. 5 is a perspective view showing one embodiment of a solenoid plunger suitable for use with a solenoid structure such as that depicted in FIG. 1.

FIG. 5 is a perspective view showing one detailed embodiment of a solenoid plunger 150 suitable for use with a solenoid structure such as that depicted in FIG. 1. The solenoid plunger 150 is constructed in substantially the same manner as the solenoid body assembly 20 described herein before with reference to FIGS. 3 and 4. More specifically, the solenoid plunger 150 is constructed of magnetic steel laminations 152 that are attached to a center block 154 which is machined to mount a solenoid shaft 160 and anti-rotate pins 162. The present invention is not so limited however, and as stated herein before, the laminations can also be formulated using, for example, sintered materials. The laminations 152 are attached to the center block 154 via a clamp structure 158 using screws 156 and vacuum epoxy glued for a very high cycle life. The laminated steel construction was found by the present inventors to dramatically reduce eddy currents, which allowed the magnetic field to rise and fall much more quickly than a conventional steel plunger to provide an unexpected but advantageous result. It was also found to increase the magnetic force in the solenoid. This reduction in solenoid plunger eddy currents and increase of magnetic force in the solenoid structure itself was discovered to operate in a manner to significantly increase embosser throughput (10 msec per character for example, in one embodiment, which correlates to a 7% improvement for a 40 character card). The laminated steel construction was further found to reduce embosser solenoid heating which also contributed to improved embossing control.

Further, the laminated steel most preferably is "cold rolled grain oriented" (CRGO) steel. The orientation of the grain has been found to provide important magnetic advantages. Those skilled in the art will readily appreciate that laminated steels have a very thin electrically insulating coating on their surface so that eddy currents, discussed herein above, can not flow from one lamination to another. In view of the foregoing, the present inventors realized that plunger plates incorporating a laminated solenoid plunger most preferably should be constructed using CRGO steel laminations that include such a thin electrically insulating coating on the surface of the CRGO steel laminations.

The present invention is not so limited however, and the present inventor surprisingly discovered that a solenoid plunger can be implemented according to the inventive principles discussed herein before, even without the use of a clamp structure such as the clamp structure 158 shown in FIG. 5, so long as the mounting hardware is capable of securing without damaging, the laminations 152 to the center block 154.

Figure 6:
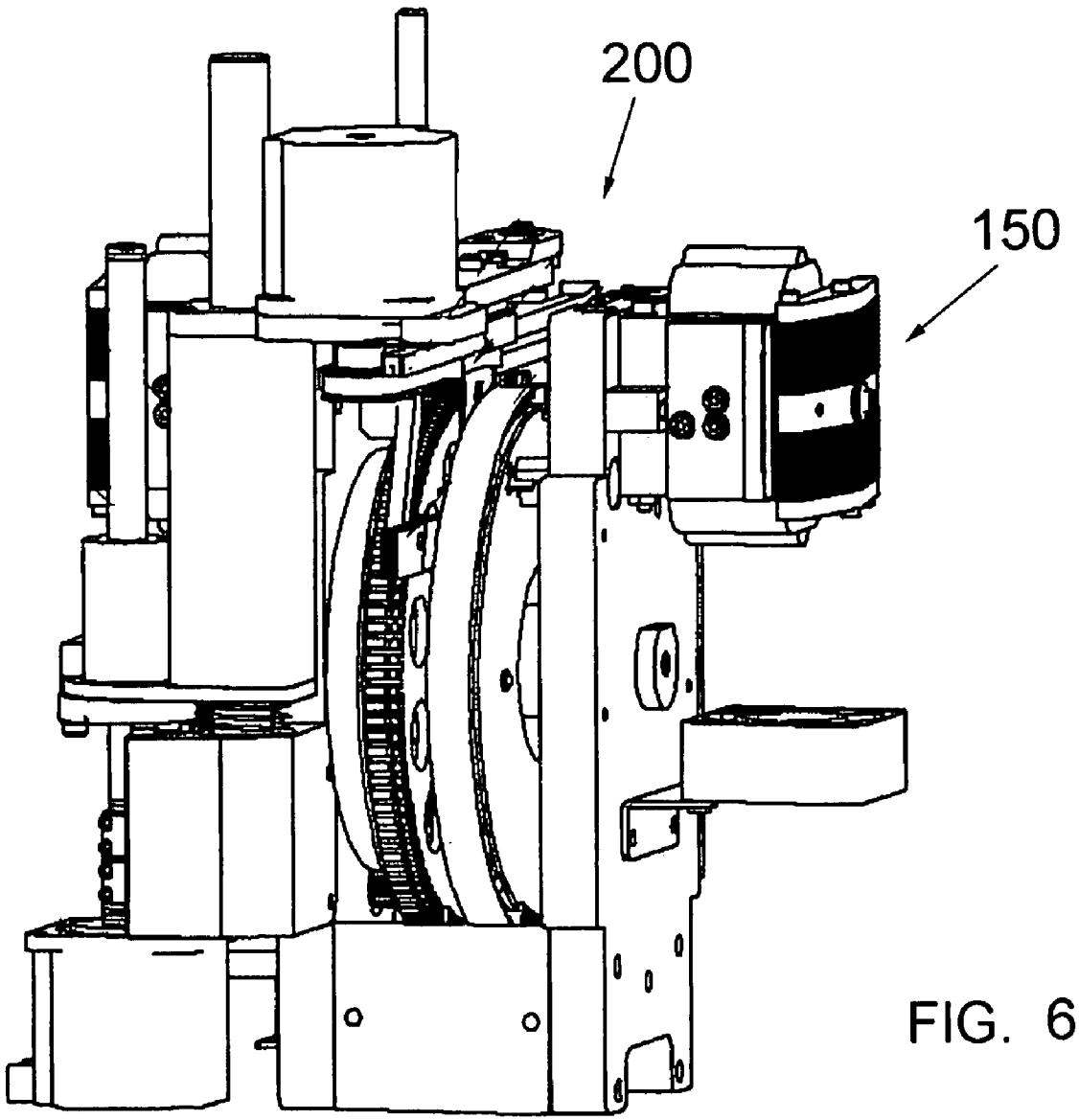
FIG. 6 is a perspective view showing a solenoid structure attached to an emboss card transport mechanism, and that employs the solenoid plunger shown in FIG. 5, according to one embodiment.

FIG. 6 is a perspective view showing a solenoid structure attached to an emboss card transport mechanism 200, and that employs the solenoid plunger 150 shown in FIG. 5, according to one embodiment.

The invention may be embodied in other forms without departing from the spirit or essential characteristics thereof. The embodiments disclosed in this application are to be considered in all respects as illustrative and not limitative. The scope of the invention is indicated by the appended claims rather than by the foregoing description; and all changes which come within the meaning and range of equivalency of the claims are intended to be embraced therein.

What is claimed is:

1. A solenoid plunger plate, comprising:

first and second laminated stacks, each stack having a plurality of alignment cavities, each alignment cavity configured for receiving an alignment mechanism there through, wherein laminations within each stack are abutting adjacent laminations;

a center block having a plurality of alignment cavities, each alignment cavity configured to receive an alignment mechanism, the center block disposed between the first and second laminated stacks;

a clamp having a plurality of alignment cavities and configured to receive the first and second laminated stacks and the center block therein; and a plurality of alignment mechanisms, each alignment mechanism being inserted into a respective clamp alignment cavity, a corresponding first stack alignment cavity, a corresponding second stack alignment cavity and a corresponding center block alignment cavity and configured to tighten the clamp against the first and second laminated stacks and the center block, wherein the first and second laminated stacks, center block and clamp together are aligned to provide a substantially flat face portion of the solenoid plunger plate.

2. The solenoid plunger plate according to claim 1, further comprising a solenoid shaft mounted to the substantially flat face portion of the center block in a direction perpendicular to the substantially flat face portion of the solenoid plunger plate to formulate a solenoid plunger.

3. The solenoid plunger plate according to claim 1, further comprising a plurality of anti-rotate pins mounted to the substantially flat face portion of the center block in a direction perpendicular to the substantially flat face portion of the solenoid plunger plate.

4. The solenoid plunger plate according to claim 1, wherein the first and second laminated stacks are comprised of steel.

5. The solenoid plunger plate according to claim 1, wherein the first and second laminated stacks are comprised of sintered material.

6. The solenoid plunger plate according to claim 1, wherein the first and second laminated stack laminations are welded to the adjacent laminations in at least one spot between each lamination.

7. The solenoid plunger plate according to claim 1, wherein the alignment mechanism comprises a screw.

8. The solenoid plunger plate according to claim 1, wherein the alignment mechanism comprises a nut and a bolt.

9. The solenoid plunger plate according to claim 1, further comprising vacuum applied epoxy glue that is vacuum applied to each alignment mechanism.

10. A solenoid plunger plate, comprising:

first and second laminated stacks, each stack having a plurality of alignment cavities, each alignment cavity configured for receiving an alignment mechanism there through, wherein laminations within each stack are abutting adjacent laminations;

a center block having a plurality of alignment cavities, each alignment cavity configured to receive an alignment mechanism, the center block disposed between the first and second laminated stacks;

a plurality of alignment mechanisms, each alignment mechanism being inserted into a respective first stack alignment cavity, a corresponding second stack alignment cavity and a corresponding center block alignment cavity and configured to secure the first and second laminated stacks against the center block, wherein the first and second laminated stacks and the center block together are aligned to provide a substantially flat face portion of the solenoid plunger plate; and a round solenoid shaft mounted to the center block so that the shaft extends therefrom in a direction perpendicular to the substantially flat face portion of the solenoid plunger plate to formulate a solenoid plunger.

11. The solenoid plunger plate according to claim 10, further comprising a plurality of anti-rotate pins mounted to the center block so that the pins extend in a direction perpendicular to the substantially flat face portion of the solenoid plunger plate.

12. The solenoid plunger plate according to claim 10, wherein the first and second laminated stacks are comprised of steel.

13. The solenoid plunger plate according to claim 10, wherein the first and second laminated stacks are comprised of sintered material.

14. The solenoid plunger plate according to claim 10, wherein the laminations of the first and second laminated stacks are welded to adjacent laminations in at least one spot between each lamination.

15. The solenoid plunger plate according to claim 10, wherein the alignment mechanism comprises a screw.

16. The solenoid plunger plate according to claim 10, wherein the alignment mechanism comprises a nut and a bolt.

17. The solenoid plunger plate according to claim 10, further comprising vacuum applied epoxy glue that is vacuum applied to each alignment mechanism.

18. The solenoid plunger plate according to claim 10, wherein each lamination comprises a cold rolled grain oriented steel lamination having an electrically insulating coating encapsulating each lamination surface.

* * * * *